US005299803A

United States Patent [19]

Halaby

[11] Patent Number: 5,299,803

[45] Date of Patent: Apr. 5, 1994

[54] APPARATUS FOR USING EMBEDDED CHIPS IN A GAMING TABLE

[76] Inventor: Josef E. Halaby, 201 W. California Ave., No. 405, Sunnyvale, Calif. 94086

[21] Appl. No.: 38,332

[22] Filed: Mar. 4, 1993

[51] Int. Cl.[5] ..... A63F 1/06

[52] U.S. Cl. ..... 273/148 R; 273/309

[58] Field of Search ..... 273/148 R, 309, 237

[56] References Cited

U.S. PATENT DOCUMENTS

| | | | |
|---|---|---|---|
| 1,510,998 | 10/1924 | Marsh | 273/309 |
| 1,803,830 | 5/1931 | Arey et al. | 273/309 |
| 2,026,682 | 1/1936 | Jeffries | 273/148 R |

*Primary Examiner*—Benjamin H. Layno

[57] ABSTRACT

A gaming table is disclosed according to which players in a table type game make their wagers by using chips that are embedded into the table. The table has apertures, with each aperture having an electro-mechanical device incorporated. Mounted on each electro-mechanical device is an adjustable elongated column graphically divided into sections resembling a stack of betting chips that are associated with each player to represent chips belonging to and wagered by each said player. The table also has manually operated switches associated with each player. The switches are electrically connected to corresponding electro-mechanical devices such that when switches are operated certain electro-mechanical devices move their corresponding elongated columns relative to its aperture simulating the increasing or decreasing of the number of chips in stacks associated with each said player. The manually operated switches are capable of causing the readjustment of all said elongated columns.

23 Claims, 5 Drawing Sheets

APPARATUS FOR USING EMBEDDED CHIPS IN A GAMING TABLE

FIELD OF INVENTION

This invention relates to the method of making wagers in a table type game such as poker, and more particularly to apparatus adapted for using adjustable embedded chips controlled by manually operated switches to make wagers.

BACKGROUND

Table type games are known in which players use chips or coins for wagering. Generally, each player arranges his chips in one or more vertical columns on the tabletop directly in front of him. In a poker game for instance, after a number of cards are dealt to all players, the first player to act makes a wager by moving to a designated betting area in front of him a number of chips that represent the nominal betting amount established for the game, or any portion of it that he possesses. Each of the following players to act in sequence then has the option to call, raise or pass. A player calls by moving to a designated betting area in front of him a number of chips equal to the highest number of chips wagered by any of the preceding players, or any portion of it that he possesses; raises by moving to said designated area a number of chips equal to the sum of the highest number of chips wagered by any of the preceding players and the number of chips representing the nominal betting amount, or any portion of it that he possesses; or passes by folding his cards and forfeiting the game. The sequence is repeated, starting with the player that originated the betting sequence, each time a raise is made by any player, until all remaining active players have wagered the same number of chips, completing a betting cycle. The chips wagered are then moved from the individual designated betting areas to a common betting area near the center of the table by a designated dealer. The chips are generally arranged in separate groups and sub-groups that each player is entitled to win in proportion to his wager when wagers are made in disproportionate amount by different players. The betting process is repeated each time a new card is dealt to the remaining players, with the designated dealer separating the chips wagered as previously described, until all but one player has exercised the pass option or the maximum number of betting cycles established for the game has been reached, ending the game.

BRIEF SUMMARY OF INVENTION

It is an object of this invention to provide a system in which players in a table type game such as poker, make their wagers by using chips that are embedded into the table.

It is another object of the invention to provide a system of the above noted-type in which an electromechanical device incorporated into the table comprises adjustable elongated vertical columns graphically divided into sections representing chips, and manually operated switches adapted to cause the displacement of said adjustable elongated columns.

It is still an object of the invention to provide a system of the above-noted type in which, said adjustable elongated columns are located in a first area in front of each player to represent chips belonging to each said player, in a second area in front of each player to represent chips wagered by each said player, in a common area near the center of the table to represent chips wagered by all players.

Still another object of the invention is to provide a system of the above-noted type in which said manually operated switches are located in front of each player to allow each said player to select a gaming option such as bet, call, raise or pass.

Yet another object of the invention is to provide a system of the above-noted type in which said elongated columns are capable of moving into and out of the table, to display any number of sections.

A further object of the invention is to provide a system of the above-noted type in which; sections in the elongated columns located in said first area in front of a player that correspond to the number of chips wagered by said player are transferred to the elongated columns in said second area in front of said player, upon selection of the bet, call or raise gaming option by said player; sections in the elongated columns located in said second area in front of each player representing chips wagered by each said player are transferred to the elongated columns located in said common area near the center of the table, upon completion of a betting cycle; sections in the elongated columns located in said common area near the center of the table that correspond to the number of chips won by any player selected as winner at the end of a game are transferred to the elongated columns in said first area in front of said player.

Still a further object of the invention is to provide a system of the above-noted type in which the activation of the bet, call or raise selection switch results in the wagering of a number of chips based on a pre-established minimum or nominal betting amount.

Yet a further object of the invention is to provide a system of the above-noted type in which a winner is selected automatically when all other players have selected the pass option after a wager has been made, or manually by the operation of switch means.

Finally it is another object of the invention to provide a system of the above-noted type in which manually operated switch means allow a designated dealer to sell and purchase chips to and from any player, causing the elongated columns located in said first area in front of said player to increase or decrease in size by a number of sections corresponding to the number of chips sold or purchased.

In achieving the above and other objects of the invention, there is proposed an electro-mechanical apparatus to be incorporated into a gaming table that comprises; adjustable elongated columns graphically divided into sections representing chips that are located in a first area in front of each player to represent chips belonging to each said player, in a second area in front of each player to represent chips wagered by each said player, in an area near the center of the table to represent chips wagered by all players; manually operated switch means located in an area in front of each player to allow each said player to exercise the traditional gaming options of bet, call, raise or pass; manually operated switch means located in a separate area that allow a designated dealer to select winners for a game and sell/purchase chips to and from any player.

Said elongated columns and switch means are arranged in such a way that; when a player presses a selection switch to wager a number of chips based on a pre-established minimum or nominal betting amount, the elongated columns located in said first and second areas in front of said player are respectively increased and decreased by a number of sections representing the number of chips wagered by said player; when a betting cycle is completed, the elongated columns located in said area near the center of the table and the elongated columns located in said second area in front of all players are respectively increased and decreased by a number of sections representing the number of chips wagered by all players; when winners are selected at the end of a game, the elongated columns located in said first area in front of a player selected as winner and the elongated columns located in said area near the center of the table are respectively increased and decreased by a number of sections representing the number of chips won by said player; when said designated dealer presses appropriate switches to sell chips to a player, the elongated columns located in said first area in front of said player are increased by a number of sections representing the number of chips purchased by said player; when said designated dealer presses switches to purchase chips from a player, the elongated columns located in said first area in front of said player are decreased by a number of sections representing the number of chips purchased from said player.

The apparatus will generally comprise motor means that move said elongated columns vertically into and out of said table, switch means that detect the displacement of each section of said elongated columns, switch means or electronic control means that detect the position of said elongated columns in reference to the surface of the table. The apparatus will also comprise electronic control means that control and monitor the operation of said manually operated switch means, motor means, switch detector means and other components of the system.

The above and other objects, features and advantages of the invention will be described in greater detail hereinafter.

DETAILED DESCRIPTION

As stated hereinabove, the invention provides a table for gaming which comprises, first means defining a plurality of adjustable elongated columns representing chips belonging to individual players, second means defining a plurality of adjustable elongated columns representing chips wagered by each individual player, third means defining a plurality of adjustable elongated columns representing chips wagered by all players, fourth means defining a plurality of switch means that allow said players to exercise the conventional gaming options in disbursing the chips owned and fifth means defining a plurality of switch means that allow a designated dealer to select winners and sell/purchase chips to and from said players.

Figure 1:
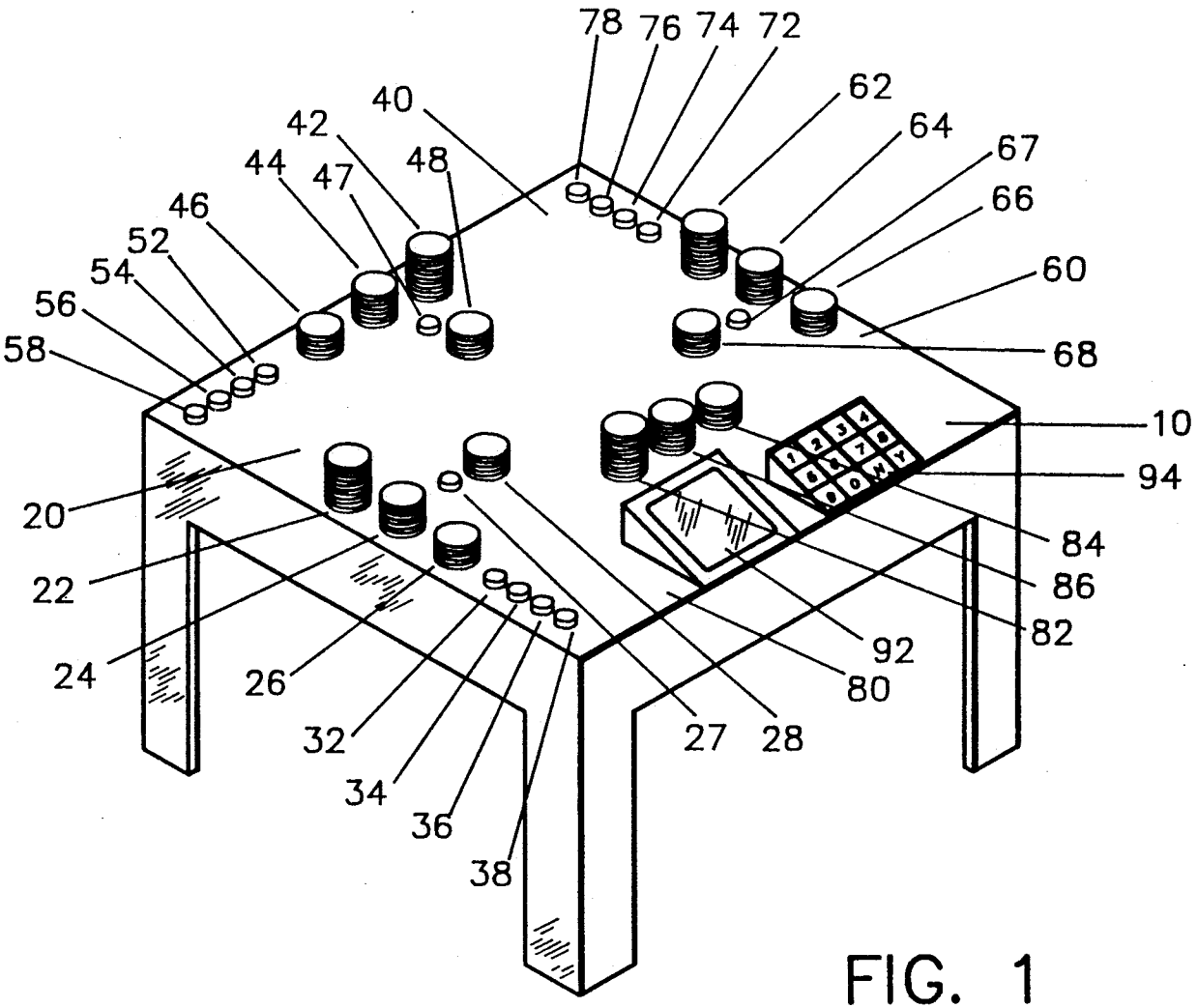
FIG. 1 is a perspective view of a table provided with embedded chips and selective switches for manipulating the chips in accordance with an embodiment of the invention.

In the drawing, the table construction illustrated in FIG. 1 comprises generally a tabletop 10 which is functionally divided into sections 20, 40 and 60 defining the area allocated to some first, second and third players respectively, and section 80 defining the area reserved for a designated dealer. Tabletop sections 20, 40 and 60 contain elongated vertical columns 22-24-26, 42-44-46 and 62-64-66 graphically divided into sections representing chips belonging to said first, second and third players, respectively, and graphically divided elongated vertical columns 28, 48 and 68 representing chips wagered by said first, second and third players, respectively. Tabletop section 80 contains graphically divided elongated vertical columns 82, 84 and 86 representing chips wagered by all players. Elongated columns 22, 24, 26, 28, 42, 44, 46, 48, 62, 64, 66, 68, 82, 84 and 86 are built into the table on movable shafts and are capable of moving vertically into and out of the table from a low position of being flush with the tabletop to a high position of perhaps twenty or forty sections above the tabletop. Tabletop sections 20, 40 and 60 also contain LEDs 27, 47 and 67 that turn on to indicate respectively that said first, second or third player is selected to select a gaming option. Tabletop sections 20, 40 and 60 also contain manually operated switches 32-34-36, 52.54-56 and 72-74-76 that allow said first, second and third players to exercise the options of bet/call, raise or pass, respectively, and manually operated on-off switches 38, 58 and 78 that allow said first, second and third players to disable switches 32-34-36, 52-54-56 and 72-74 76, respectively.

Tabletop section 80 contains keyboard 94 that allows said designated dealer to set the parameters for the game, select winners, sell chips to players, purchase chips from players, and monitor 92 that displays operation menus and data entered on said keyboard.

The table shown is square and is set to accommodate three players, but it may as well be of any suitable shape and set to accommodate any appropriate number of players.

Figure 2:
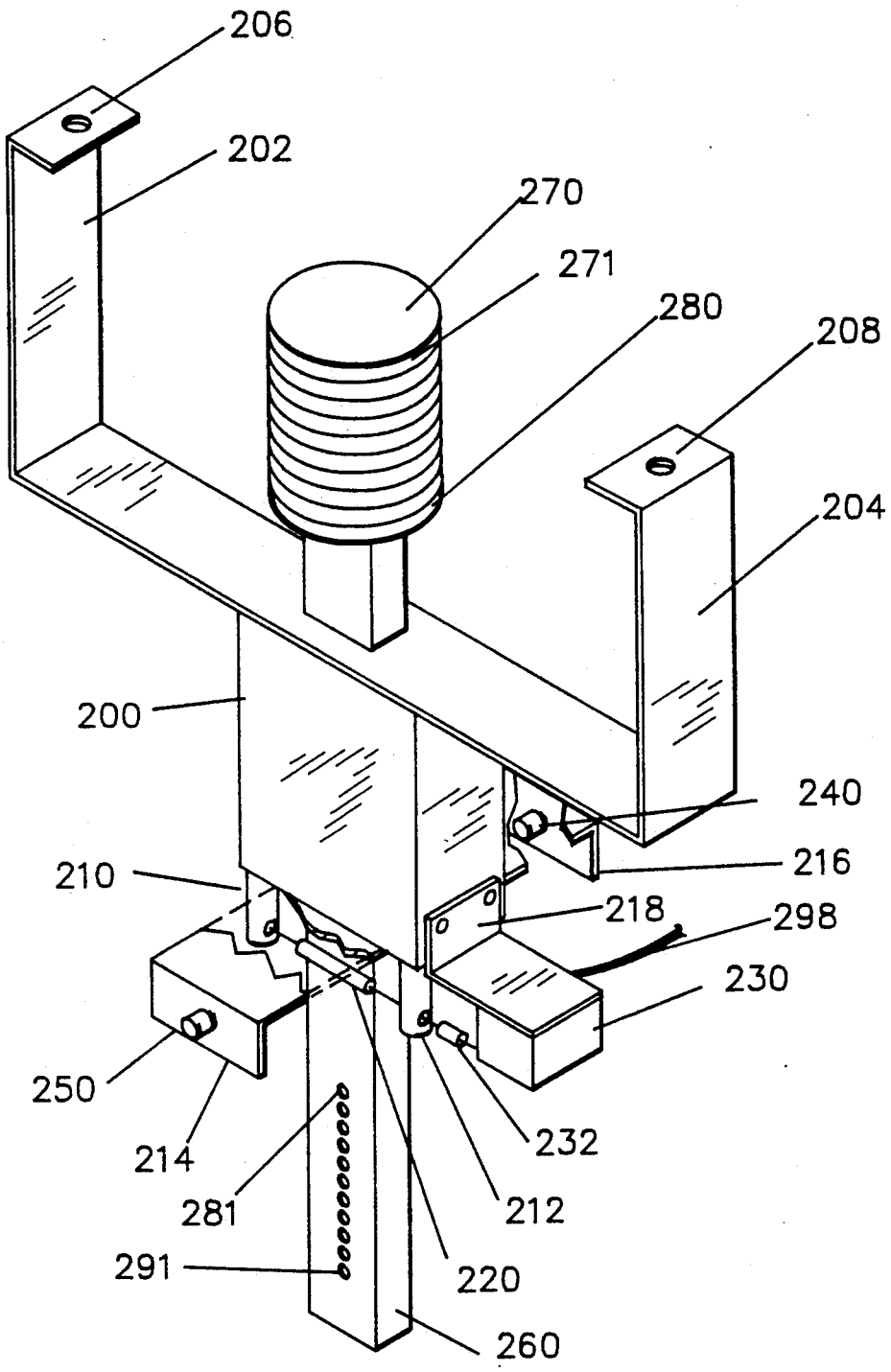
FIG. 2 is a perspective view illustrating the construction of the embedded chips referred to in FIG. 1.

FIG. 2 illustrates perspectively one of the elongated vertical columns of FIG. 1. Elongated rectangular rod 260, terminated at its upper section with elongated column 270 graphically divided into sections 271–280, slides freely into a matching rectangular hole at the center of rectangular metal block 200. Mounting holes 206 and 208, at the end of brackets 202 and 204 attached to metal block 200, are intended for securing said metal block to the inside surface of the tabletop with mounting screws. A hole through the tabletop allows elongated column 270 to move vertically through the tabletop. Brackets 202 and 204 are of such length as to align the top surface of elongated column 270 with the tabletop when the bottom surface of said elongated column comes to rest on the surface of metal box 200.

Elongated rod 260 is divided at its lower section by a number of perforations 281–291, equally spaced as the sections of column 270.

Photo detector 250, mounted on bracket 214 on one side of metal block 200 to directly face the perforations of elongated rod 260, detects the light beam emitted by light emitter 240, mounted on bracket 216 at the opposite side of metal block 200, through perforations 281–291. Brackets 214 and 216 are adjusted to align photo detector 250 and light emitter 240 with perforation 281 when the top surface of section 271 is aligned with the tabletop, causing perforations 282, 283, 284, 285, 286, 287, 288, 289, 290 and 291 to be similarly aligned with said photo detector and light emitter when the bottom line of sections 271, 272, 273, 274, 275, 276, 277, 278, 279 and 280 is aligned with the tabletop, respectively, as elongated rod 260 moves vertically through metal block 200.

Spring-loaded roller 220 is positioned over the lower section of elongated rod 260 with its pivotal ends inserted into circular holes onto brackets 210 and 212 attached to opposite ends of metal block 200 so that; as it is rotated clockwise or counter-clockwise, it forces elongated rod 260 to move vertically downward or upward.

Housing 230, attached to metal block 200 by bracket 218, contains a high torque electric motor with its shaft attached to one pivotal end of roller 220 by coupler 232.

As a result of these arrangements, when the electronic control circuitry sends a signal to the electric motor to rotate the shaft of said motor clockwise or counter-clockwise, roller 220 forces elongated rod 260 to move down or up, and photo detector 250 sends a signal to said electronic control circuitry each time said elongated column moves down or up the tabletop by one section. Cable 298 connects said electric motor, photo detector and light emitter to said electronic control circuitry. The motor above-mentioned may be a reversible high-torque synchronous motor with sudden stop characteristic or a stepper motor driven by a conventional driver IC to rotates its shaft in incremental stepping motion.

Figure 3:
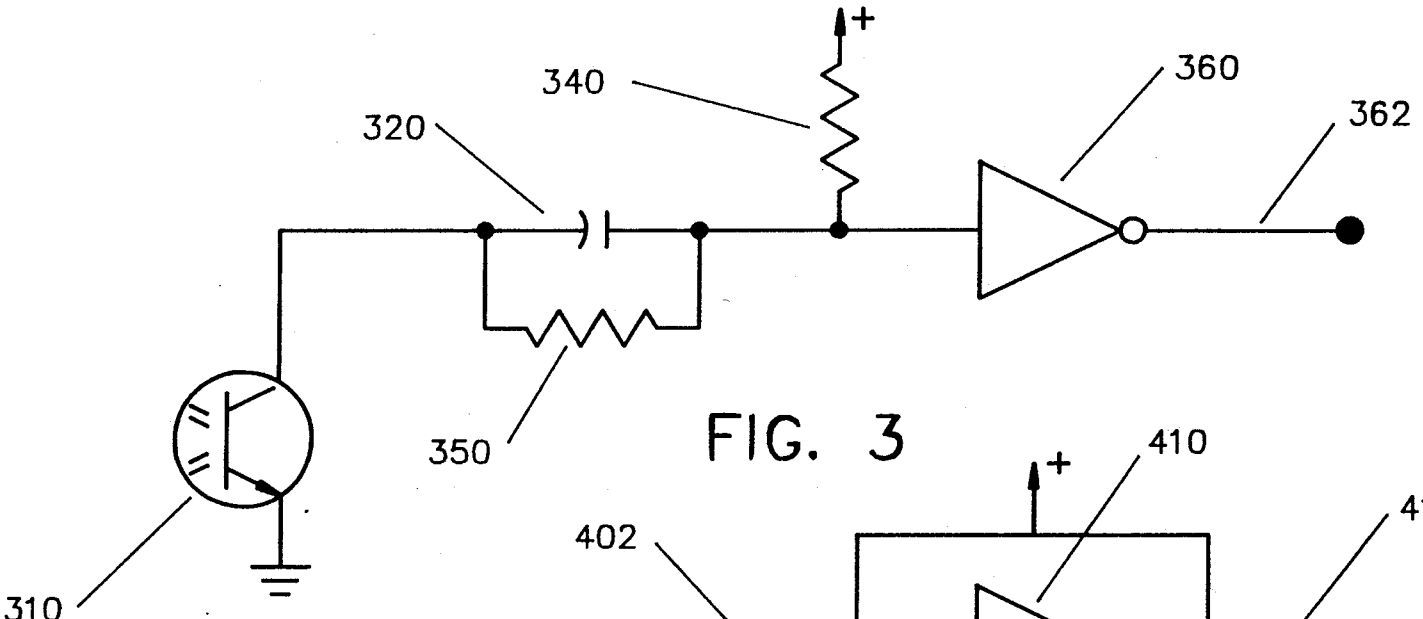
FIG. 3 and FIG. 4 are schematic diagrams of the circuitry that interfaces the components referred to in FIG. 2 to the electronic control system that controls the operation of the system.

FIG. 3 illustrates the circuitry that interconnects the photo detector associated with the elongated column described in FIG. 2 to the electronic control system that operates the system. Upon detection of a light beam, photo detector 310 is activated to supply a negative voltage to the input of the RC filter formed by capacitor 320 and resistors 340, 350. As a result, the input of inverter 360, connected to the output of said RC filter, goes negative for the charging time of capacitor 320, causing the output of said inverter to go positive and supply a detecting signal to the electronic control system via line 362. Consequently in reference to FIG. 2, when the electronic control system supplies power to the electric motor to move elongated rod 260, inverter 360 sends a brief signal to said electronic control system when photo detector 250 detects a perforation in said elongated column, and if said electronic control system at that moment removes power from said motor to stop the motion of said elongated rod, said photo detector remains activated, keeping capacitor 320 of said RC filter charged and unabled to reactivate said inverter. When said electronic control system again supplies power to said motor to move said elongated rod, said photo detector is deactivated, allowing the discharge of capacitor 320 by resistor 350 to enable said RC filter to again drive the input of inverter 450 negative when said photo detector detects another perforation in said elongated rod.

Figure 4:
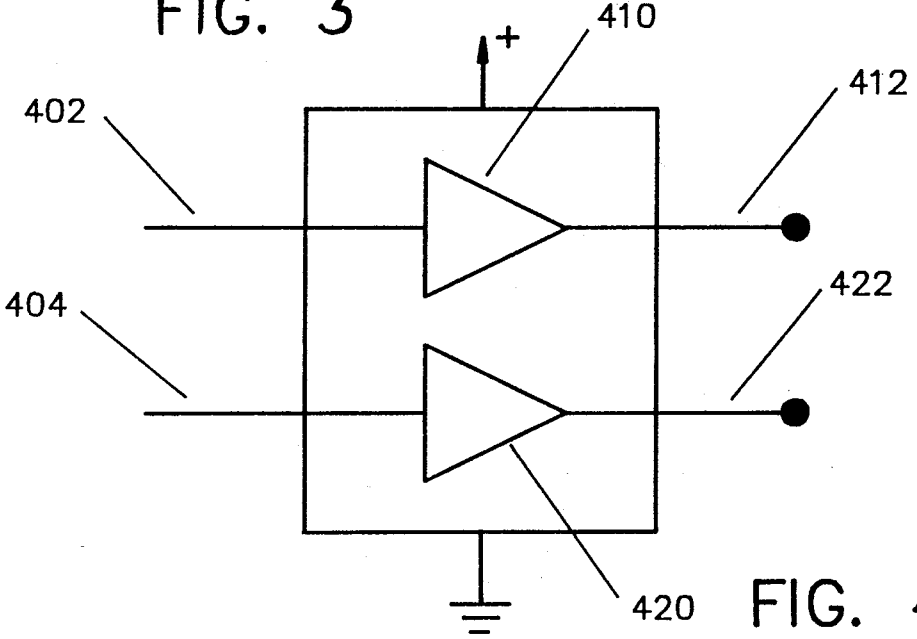

FIG. 4 illustrates the circuitry that interconnects the motor associated with the elongated column described in FIG. 2 to the electronic control system that operates the system. The electronic control system supplies an electrical signal to driver 410 via line 402 to operate the motor in a clockwise rotation, and to driver 420 via line 404 to operate said motor in a counter-clockwise rotation. Drivers 410 and 420 are bi-polar current amplifiers that provide a high sink current output in the absence of an input signal and a high source current output when an input signal is applied. A signal applied to line 402 activates driver 410 to supply a positive voltage to line 412 while line 422 is held negative by driver 420, and a signal applied to line 404 activates driver 420 to supply a positive voltage to line 422 while line 412 is held negative by driver 410. A motor connected to lines 412 and 422 rotates clockwise of counter-clockwise depending on the polarity of the voltage on lines 412 and 422.

Figure 5:
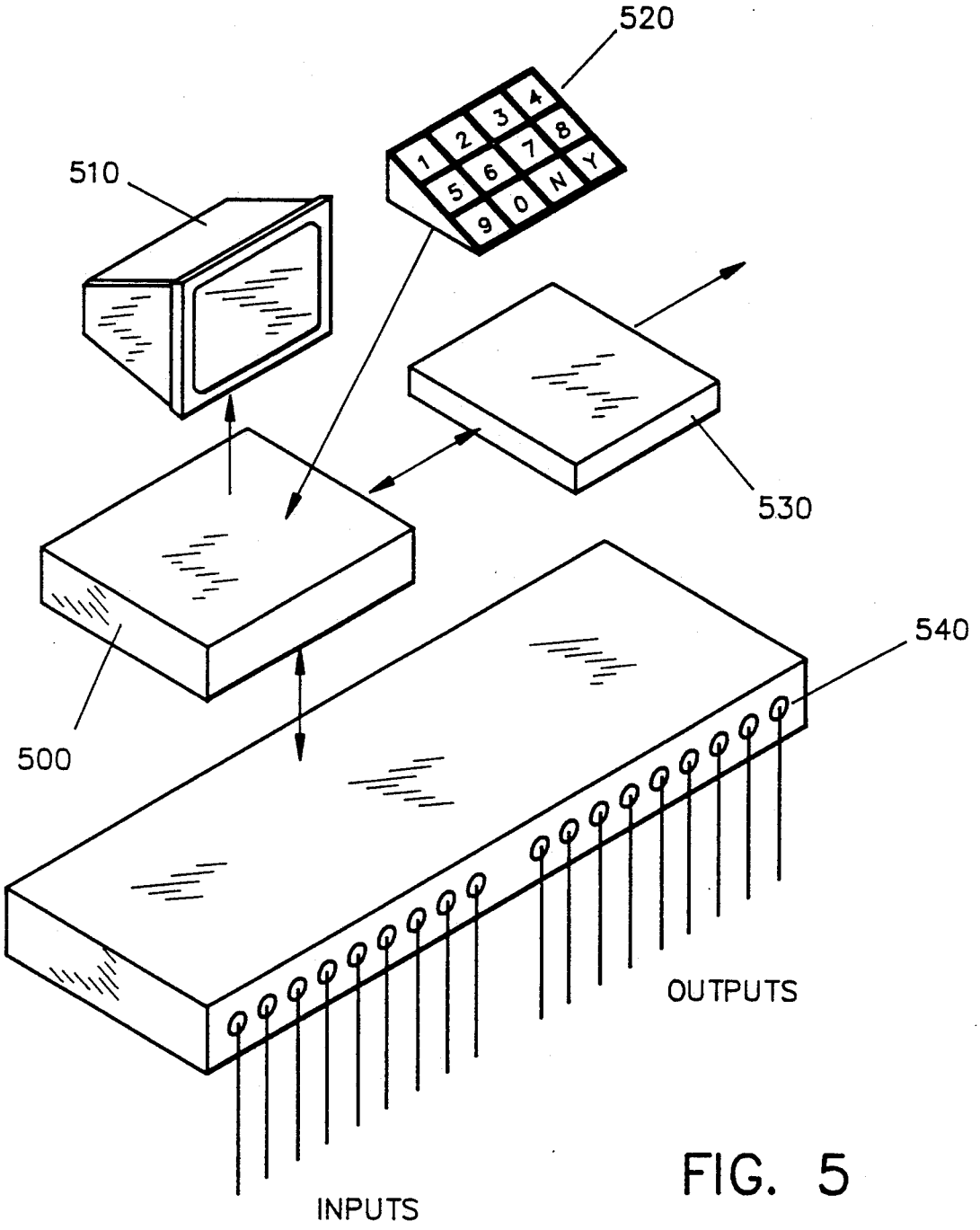
FIG. 5 is a block diagram of the electronic control system that controls and monitors all the components incorporated within the table.

FIG. 5 illustrates the PC-based data acquisition and control system that monitors and controls all the active components incorporated within the gaming table. It is composed of personal computer or CPU card 500, monitor 510, keyboard 520, I/O card 540, and communication interface card 530.

The input lines of I/O card 540 detect the contact closure of the manually operated selection switches associated with the players and the mechanically operated sensor switches associated with the adjustable elongated columns. I/O card 540 converts said contact closures into digital signals that are transmitted to computer 500 for processing.

The output lines of I/O card 540 control the operation of the LEDs incorporated into the table and the motors associated with the adjustable elongated columns. I/O card 540 converts the digital output signals generated by computer 500 into discrete signals at said output lines.

The software that operates the system is booted into the personal computer or loaded into the disk ROM of the CPU card. Keyboard 520 preferably contains only the keys that are useful to the designated dealer to sell/purchase chips and select winners, namely the numeric keys 1–0 and the Y and N keys. Communication interface card 530, such as an RS 232 or IEEE 488 module, connects computer 500 to a host computer for the downloading and uploading of data. PC-based data acquisition and control system comprising I/O cards, are very conventional and need no further clarification in this text.

Figure 6:
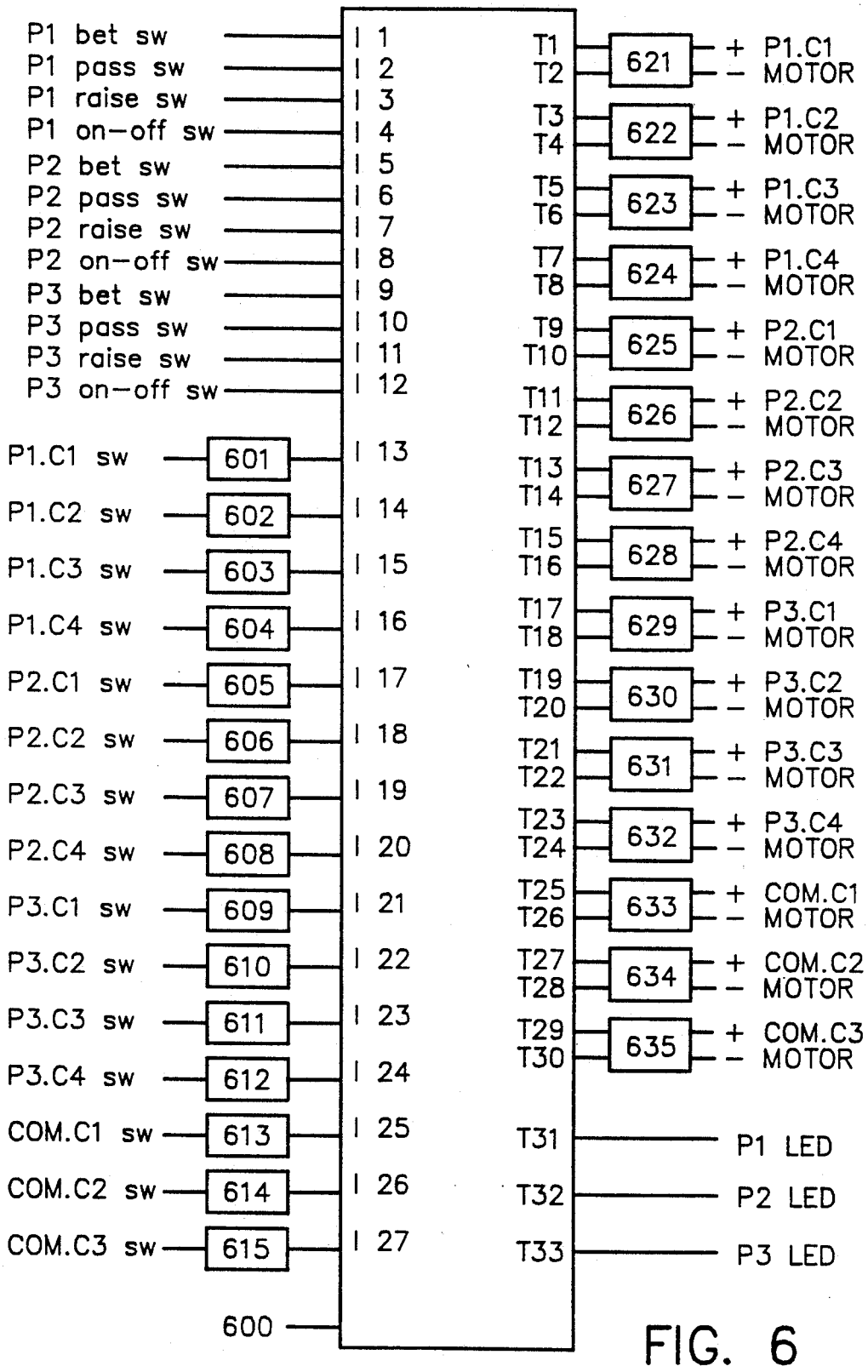
FIG. 6 is a block diagram illustrating the electrical connections of the components of the system to the electronic control system referred to in FIG. 5.

FIG. 6 illustrates the connections of all the components of the system to the I/O card of FIG. 5.

Inputs I1 to I4 are connected to the bet/call, pass, raise and on-off switches associated with the first player, inputs I5 to I8 are connected to the corresponding witches associated with the second player and inputs I9 to I12 are connected to the corresponding switches associated with the third player. Inputs I13 to I27 are connected to the sensor incorporated within elongated columns P1.C1, P1.C2, P1.C3, P1.C4, P2.C1, P2.C2, P2.C3, P2.C4, P3.C1, P3.C2, P3.C3, P3.C4, Com.C1, Com.C2 and Com.C3, respectively, via RC filters 601, 602, 603, 604, 605, 606, 607, 608, 609, 610, 611, 612, 613, 614 and 615, of the type illustrated in FIG. 3.

Outputs T1 and T2 provide signals to operate the motor controlling the displacement of elongated column P1.C1 in a clockwise or counter-clockwise rotation respectively, via driver module 621, of the type illustrated in FIG. 4. Similarly, outputs T3 and T4, T5 and T6, T7 and T8, T9 and T10, T11 and T12, T13 and T14, T15 and T16, T17 and T18, T19 and T20, T21 and T22, T23 and T24, T25 and T26, T27 and T28, T29 and T30, provide signals to operate the motor controlling the displacement of elongated columns P1.C2, P1.C3, P1.C4, P2.C1, P2.C2, P2.C3, P2.C4, P3.C1, P3.C2, P3.C3, P3.C4, Com.C1, Com.C2, Com.C3, respectively, via driver modules 622, 623, 624, 625, 626, 627, 628, 629, 630, 631, 632, 633, 634 and 635.

Outputs T37, T38 and T39 control the operation of LEDs associated with the first, second and third players, respectively.

Flow-chart 1000–2000 illustrates the logic of the computer program that operates the system. It is functionally divided into several sections. In the explanation that follows: Counters P1.chip.cnt, P2.chip.cnt and P3.chip.cnt store the number of chips belonging to the first, second and third players, respectively. Counters P1.Nbet.cnt, P2.Nbet.cnt, P3.Nbet.cnt store the number of chips wagered by said first, second, third players, respectively, at any given time. Counters P1.bet.cnt, P2.bet.cnt, P3.bet.cnt store the number of chips wagered by said first, second, third players, respectively, in a betting cycle. Counters P1.Tbet.cnt, P2.Tbet.cnt, P3.Tbet.cnt store the number of chips wagered by said first, second, third players, respectively, in all the betting cycles of a game. Counter com.bet.cnt stores the number of chips wagered by all players in a betting cycle and counter com.Tbet.cnt stores the number of chips wagered by all players in a game. Counter amt-bet-cnt stores the nominal betting amount established for the game or the highest wager made by any player in a betting cycle. Counter done-cnt accumulates the total of players that have selected a betting option or that are excluded from selecting a betting option in a betting cycle, and counter cycle.cnt accumulates the number of betting cycles that are played. Counter str.cnt stores the number identifying the player selected to initiate the betting process for each game and counter ply.cnt stores the number identifying the player elected to select a gaming option. Counter w.cnt stores the number of selected winners in a game, counter com.w.cnt stores the number of chips won by selected winners. Counters P1.w.cnt, P2.w.cnt and P3.w.cnt store the number of chips won by said first, second and third players respectively. Counter tst.cnt temporarily stores data in-process.

Elongated columns P1.c1, P1.c2, P1.c3, elongated columns P2.c1, P2.c2, P2.c3 and elongated columns P3.c1, P3.c2, P3.c3 represent chips belonging to said first, second and third players, respectively. Elongated columns P1.c4, P2.c4 and P3.c4 represent chips wagered by said first, second and third players, respectively. Elongated columns com.c1, com.c2 and com.c3 represent chips wagered by all players. All said elongated columns are composed of a number of sections such as thirty or forty, for instance, and "MC" represents the maximum number of sections in each column. Each section of elongated columns P1.c1, P1.c2, P1.c4, P2.c1, P2.c2, P2.c4, P3.c1, P3.c2, P4.c4, com.c1 and com.c2 represents one chip of basic denomination such as one for instance, and each section of elongated columns P1.c3, P2.c3, P3.c3 and com.c3 represents one chip of higher denomination "CD" such as four or five, for instance.

Counters P1.c1.cnt, P1.c2.cnt, P1.c3.cnt, P1.c4-cnt, P2.c1.cnt, P2.c2.cnt, P2.c3.cnt, P2.c4.cnt, P3.c1.cnt, P3.c2.cnt, P3.c3.cnt, P3.c4.cnt, com.c1.cnt, com.c2.cnt and com.c3-cnt indicate respectively the number of sections of elongated columns P1.c1, P1.c2, P1.c3, P1.c4, P2.c1, P2.c2, P2.c3, P2.c4, P3.c1, P3.c2, P3.c3, P3.c4, com.c1, com.c2 and com.c3 that are displayed. Counters P1.res.cnt, P2.res.cnt and P3.res.cnt store the number of chips belonging to said first, second and third players that cannot be displayed by the elongated columns representing chips belonging to said first, second and third players, respectively. Counter com.res.cnt contains the number of chips wagered by all players that cannot be displayed by the elongated columns representing chips wagered by all players.

Counters P1.Cup.cnt, P2.Cup.cnt, P3.Cup.cnt store respectively the number of sections by which the elongated columns representing chips belonging to said first, second, third players are to be raised, and counters P1.Cdn.cnt, P2.Cdn.cnt, P3.Cdn.cnt store respectively the number of sections by which said elongated columns are to be lowered. Counters P1.Bup.cnt, P2.Bup.cnt, P3.Bup.cnt store respectively the number of sections by which the elongated columns representing chips wagered by said first, second, third players are to be raised, and counters P1.Bdn.cnt, P2.Bdn.cnt, P3.Bdn.cnt store respectively the number of sections by which said elongated columns are to be lowered. Counters com.Bup.cnt and com.Bdn.cnt store respectively the number of sections by which the elongated columns representing chips wagered by all players are to be raised and lowered.

Indicators P1 LED, P2 LED and P3 LED indicate respectively that said first, second and third player are selected to select a gaming option.

Flags P1.done.flg, P2.done.flg, P3.done.flg indicate respectively that said first, second, third players have exercised a betting option during a betting cycle, and flags P1.pass.flg, P2.pass.flg, P3.pass.flg indicate respectively that said first, second, third players have elected to drop out of the game. Com.bet.flg indicates that a wager has been made by any player. Flags P1.w.flg, p2.w.flg and P3.w.flg indicate that said first, second and third players are selected winners, respectively.

Variable "NX" represents the minimum or nominal betting amount for the game which may be from two to eight, for instance, variable "NP" represents the maximum number of players in the game which may be from two to ten, for instance, and variable "NC" represents the maximum number of betting cycles in the game which may be from two to six, for instance.

Flow-chart section 1000 illustrates the process of selecting an operation mode for the system. Menu 1 is displayed on screen 92, prompting the designated dealer to press key 1, 2 or 3 on keyboard 94, to select the option of purchasing chips from a player, selling chips to a player or starting a game. Operation then goes to section 1100, 1200 or 1300, depending on the selection made.

Flow-chart section 1100 illustrates the process of selling chips to a player. Menu 2 is displayed on screen 92, prompting the designated dealer to enter on keyboard 94, the number corresponding to the player to whom chips are to be sold and the number of chips being sold. The data entered is displayed on screen 92. The Y or N key on keyboard 94 is then pressed to complete or cancel the transaction. When the Y key is pressed, the number of chips entered is added to the number of chips belonging to the player purchasing the chips in P1.chip.cnt, P2.chip.cnt or P3.chip.cnt, and to the counter controlling the upward motion of the elongated columns representing chips belonging to said player, P1.Cup.cnt, P2.Cup.cnt or P3.Cup.cnt, and subroutine 2000 is called to perform the readjustment of said elongated columns. Operation returns to section 1000.

Flow-chart section 1200 illustrates the process of buying chips from a player. Menu 3 is displayed on screen 92, prompting the designated dealer to enter on keyboard 94, the number corresponding to the player from whom chips are to be purchased. The number entered and the number of chips belonging to the corresponding player in P1.chip.cnt, P2.chip.cnt or P3.chip.cnt are displayed on screen 92. The Y or N key on keyboard 94 is then pressed to complete or cancel the transaction. When the Y key is pressed, the number of chips belonging to said player in P1.chip.cnt, P2.chip.cnt or P3.chip.cnt is transferred to the counter controlling the downward motion of the elongated columns representing chips belonging to said player, P1.Cdn.cnt, P2.Cdn.cnt or P3.Cdn.cnt, and sub-routine 2000 is called to perform the readjustment of said elongated columns. Operation returns to section 1000.

Flow-chart section 1300 illustrates the process of selecting a player to initiate the betting process in a game. Menu 3 is displayed on screen 92, prompting the designated dealer to enter on keyboard 94, the number corresponding to the player designated to initiate the betting process, based on some condition of the game being played. A valid number entered is stored in counters str.cnt and ply.cnt, and operation goes to section 1400. An invalid number entered returns operation to section 1000.

Flow-chart section 1400 illustrates the betting process involving the first player. P1 LED flashes on to indicate to said first player that it is his turn to select a betting option when the player selection counter ply.cnt is set at one, providing that said first player possesses chips, the switch controlling the distribution of said chips is in the on position and said first player has not already selected a betting option in the current betting cycle. Said first player selects a betting option by pressing the pass switch, the bet/call switch or the raise switch, located directly in front of him.

The pass switch is pressed to concede the betting initiative to the next player or to drop out of the game. When a wager had not been made in the current betting cycle, said first player concedes to the next player the option of initiating a wager while remaining an active participant in the game. When a wager had previously been made, said first player forfeits his participation in the game and flag P1.pass.flg is set to indicate that condition.

The bet/call switch is pressed to initiate a wager in the current betting cycle or to call a wager made by another player. When a wager is initiated, the com.bet.-flag is set to indicate that condition, the done.cnt, which registers the number of players that have already selected the pass option in the current betting cycle, and the done.flags, which identify the players that have selected the pass option, are reset to allow said players to exercise a new betting option. Said first player's current wager in P1.Nbet.cnt is the nominal amount of a wager NX or any portion of it that said first player possesses. When a wager is called, said first player's current wager in P1.Nbet.cnt is the difference between the amount in amt.bet.cnt, which is the nominal amount of a wager NX or the highest wager made by any player in the current betting cycle, and the amount previously wagered by said first player in the current betting cycle in P1.bet.cnt, or any portion of that value that said first player possesses.

The raise switch is pressed to increase the wager made by another player. The highest wager made by any player in the current betting cycle in amt.bet.cnt is increased by the nominal amount of a wager NX, or any portion of that amount that said first player possesses that is in excess to the amount in formerly in amt-.bet.cnt. Said first player's current wager is the difference between the amount in amt.bet.cnt and the amount previously wagered by said first player in P1.bet.cnt. The done.cnt and the done.flgs are reset to allow the other players that have already selected a betting option in the current betting cycle to exercise a new betting option.

Once the first player exercises a betting option, said first player's current wager is deducted from the number of chips belonging to said first player in P1.chip.cnt and added to the number of chips previously wagered by said first player in the current betting cycle in P1.bet.cnt. The amount of that wager is also added to the counters controlling the downward and upward motion of the elongated columns representing chips belonging to and wagered by said first player, P1.Cdn.cnt and P1.Bup.cnt, and the P1 LED is turned off.

Whether said first player exercises a gaming option or is prevented from exercising one, the P1.done.flg is set and the done.cnt incremented by one. The number in ply.cnt is incremented by one or set to one, to point to the next player. Sub-routine 2000 is called to perform the readjustment of the elongated columns. Operation then goes to section 1500.

Flow-chart section 1500 performs the betting process involving the second player when counter Ply.cnt is set at two and flow-chart section 1600 performs the betting process involving the third player when counter Ply.cnt is set at three, in the same manner as section 1400, with P2 LED, P2 pass sw, P2 bet sw, P2 raise sw, P2.chip.cnt, P2.Nbet.cnt, P2.bet.cnt, P2.Cdn.cnt, P2.Bup.cnt, P2.done.flg, P2.pass.flg, and P3 LED, P3 pass sw, P3 bet sw, P3 raise sw, P3.chip.cnt, P3.Nbet.cnt, P3.bet.cnt, P3.Cdn.cnt, P3.Bup.cnt, P3.done.flg, P3.pass.flg, performing, respectively, the same functions as P1 LED, P1 pass sw, P1 bet sw, P1 raise sw, P1.chip.cnt, P1.Nbet.cnt, P1.bet.cnt, P1.Cdn.cnt, P1.Bup.cnt, P1.done.flg, P1.pass.flg. Operation then goes to section 1700.

Flow-chart section 1700 illustrates the control process after the last player has selected a gaming option. The done.cnt determines the end of a betting cycle when the number registered is equal to the number of players in the game, indicating that all eligible players have exercised a betting option the same number of times. When the betting cycle is not complete, the done.cnt is cleared and the betting process resumes in section 1400. When the betting cycle is complete, the number of chips wagered by the first player during the betting cycle in P1.bet.cnt is added to, the total number of chips wagered by said first player in the game in P1.Tbet.cnt, the total number of chips wagered by all players during the betting cycle in com.bet.cnt, the total number of chips wagered by all players in the game in com.Tbet.cnt, and to the counter controlling the downward motion of the elongated columns representing chips wagered by said first player in P1.Bdn.cnt. Similar operation is performed with P2.bet.cnt and P3.bet.cnt for the second and third players, respectively. The number of chips wagered by all players during the betting cycle in com.bet.cnt is added to the counter controlling the upward motion of the elongated columns representing chips wagered by all players in com.Bup.cnt. Subroutine 2000 is called to perform the readjustment of the elongated columns.

When the total number of players that have selected the pass option or that do not possess chips to wager is equal to the number of players in the game minus one or when the number in the betting cycle counter cycle-cnt is equal to the maximum number of betting cycles NC allowed for the game, the betting process is terminated and operation goes to section 1800. When neither of the two stated conditions terminating the betting process is met, the cycle-cnt is incremented by one, the done.cnt, amt-bet-cnt, com-bet-flag and done-flags are reset and operation goes back to section 1400 to begin a new betting cycle, after the player that had originated the first betting cycle for the game is again selected to begin the new betting cycle.

Flow-chart section 1800 illustrates the winner selection process. When all but one of the players has selected the pass option, after a wager is made, the winner counter w.cnt is set to one, the winner selection flag corresponding to the player that has not selected the pass option is set and operation moves to section 1900. When the automatic selection of a winner is not accomplished, menu 5 is displayed on screen 92, prompting the designated dealer to enter on keyboard 94, numbers 1, 2 and 3 to respectively select the first, second and third players as winners. The numbers entered are displayed on screen 92, the winner selection flags corresponding to the numbers entered are set and the winner counter w.cnt is incremented by one for each number entered. The Y or N key is then pressed to respectively accept the selection made and moves operation to section 1900, or cancel the selection made and allow the selection process to be repeated.

Flow-chart section 1900 illustrates the computation of chips won by selected winners. The amount wagered by each player that is equal to the lowest amount wagered by any selected winner is transferred to the counter storing the amount won by all selected winners. This is accomplished by repeatedly subtracting one from the amount wagered by each player in P1.Tbet.cnt, P2.Tbet.cnt, P3.Tbet.cnt and adding it to com.win.cnt, as long as the amount wagered by all selected winners is greater than zero. The amount in com.win.cnt is then divided by the number of selected winners in W.cnt and the result is added to the counters that store the number of chips won by each selected winner, P1.w.cnt, P2.w.cnt or P3.w.cnt.

The win selection flag of any selected winner whose total wager is reduced to zero is then reset and the W.cnt is decreased by one in each such case. The process is repeated until all winner selection flags are reset.

The number of chips won by the first player in P1.w.cnt is added to the number of chips possessed by said player in P1.chip.cnt and to the counter controlling the upward motion of the elongated columns representing chips belonging to said first player P1.Cup.cnt. Similar operation is performed with the chips won by the second player in P2.w.cnt and the chips won by the third player in P3.w.cnt. The number of chips won by all selected winners in com.w.cnt is subtracted from the total number of chips wagered by all players in com.-Tbet.cnt and added to the counter controlling the downward motion of the elongated columns representing chips wagered by all players in com.Bdn.cnt. Subroutine 2000 is called to perform the readjustment of the elongated columns.

When all the chips wagered in com.Tbet.cnt have been distributed to selected winners, the game is over and operation goes to section 1000 for the selection of a new operation mode, otherwise operation goes back to section 1800 for the selection of new winners for the distribution of the chips still in com.Tbet.cnt.

Flow-chart 2000 illustrates the chip readjustment routine that is called upon from various points in the main program illustrated in sections 1000–1900, to raise or lower the elongated columns representing chips belonging to and wagered by all players.

In section 2000, the elongated columns representing chips belonging to the first player are readjusted if the counters controlling the upward and downward motion of said elongated columns contain any significant value.

As long as the amount in P1.Cup.cnt is greater than zero: the motor controlling the displacement of elongated column P1.c1 is activated in a counter-clockwise rotation to raise said elongated column by one section and increase the content of P1.c1.cnt by one, each time the amount in P1.Cup.cnt is decreased by one, until said elongated column reaches its highest position when the content of P1.c1.cnt equates MC; then, the motor controlling the displacement of elongated column P1.c2 is activated in a counter-clockwise rotation to raise said elongated column by one section and increase the content of P1.c2.cnt by one, each time the amount in P1.Cup.cnt is decreased by one, until said elongated column reaches its highest position when the content of P1.c2.cnt equates MC; then, the motor controlling the displacement of elongated column P1.c3 is activated in a counter-clockwise rotation to raise said elongated column by one section and increase the content of P1.c3.cnt by one, each time the amount in P1.Cup.cnt is decreased by the amount CD, until said elongated column reaches its highest position when the content of P1.c3.cnt equates MC; then the amount in P1.Cup.cnt is transferred to P1.res.cnt.

As long as the amount in P1.Cdn.cnt is greater than zero: The amount in P1.Cdn.cnt is first reduced by whatever amount is in P1.res.cnt; then, the motor controlling the displacement of elongated column P1.c3 is activated in a clockwise rotation to lower said elongated column by one section and decrease the content of P1.c1.cnt by one, each time the amount in P1.Cdn.cnt is decreased by the amount CD, until said elongated column reaches its lowest position when the content of P1.c3-cnt is zero; then, the motor controlling the displacement of elongated column P1.c2 is activated in a clockwise rotation to lower said elongated column by one section and decrease the content of P1.c2.cnt by one, each time the amount in P1.Cdn.cnt is decreased by one, until said elongated column reaches its lowest position when the content of P1.c2.cnt is zero; then, the motor controlling the displacement of elongated column P1.c1 is activated in a clockwise rotation to lower said elongated column by one section and decrease the content of P1.c1.cnt by one, each time the amount in P1.Cdn.cnt is decreased by one, until said elongated column reaches its lowest position when the content of P1.c1.cnt is zero.

In section 2020, the elongated columns representing chips belonging to the second player are readjusted if the counters controlling the upward and downward motion of said elongated columns contain any significant value, in the same manner as in section 2000.

In section 2030, the elongated columns representing chips belonging to the third player are readjusted if the counters controlling the upward and downward motion of said elongated columns contain any significant value, in the same manner as in section 2000.

In section 2040, the elongated columns representing chips wagered by all players are readjusted if the counters controlling the upward and downward motion of said elongated columns contain any significant value, in the same manner as in section 2000.

In section 2050, the elongated column representing chips wagered by the first player is readjusted if the counters controlling the upward and downward motion of said elongated column contain any significant value.

As long as the amount in P1.Bup.cnt is greater than zero: the motor controlling the displacement of elongated column P1.c4 is activated in a counter-clockwise rotation to raise said elongated column by one section and increase the content of P1.c4.cnt by one, each time the amount in P1.Bup.cnt is decreased by one, until said elongated column reaches its highest position when the content of P1.c4.cnt equates MC.

As long as the amount in P1.Cdn.cnt is greater than zero: the motor controlling the displacement of elongated column P1.c4 is activated in a clockwise rotation to lower said elongated column by one section and decrease the content of P1.c4.cnt by one, each time the amount in P1.Cdn.cnt is decreased by one, until said elongated column reaches its lowest position when the content of P1.c4.cnt is zero.

In section 2060, the elongated column representing chips wagered by the second player is readjusted if the counters controlling the upward and downward motion of said elongated column contain any significant value, in the same manner as in section 2050.

In section 2070, the elongated column representing chips wagered by the third player is readjusted if the counters controlling the upward and downward motion of said elongated column contain any significant value, in the same manner as in section 2050.

Operation returns to whatever point in the main program 1000–1900 from where sub-routine 2000 was called.

From the logic diagrams and flow-charts illustrated, the actual computer programs and codes to operate the system described can be generated by anyone skilled in the art. Those computer programs and codes are not part of this invention, except as produced to operate the system as described.

There will now be obvious to those skilled in the art many modifications and variations of the apparatus of the invention set forth above. These modifications and variations will not depart from the scope of the invention as defined by the following claims.

What is claimed is:

1. A gaming table for playing games thereon comprising:

a playing surface having a plurality of apertures thereon;

a plurality of elongated one-piece columns, each column graphically divided into sections to represent a stack of betting chips, each elongated column sized and shaped to fit into a corresponding aperture;

a mounting means adjacent each aperture for mounting each elongated column in each corresponding aperture, each of said mounting means including an adjusting means for adjusting the position of each elongated column relative to its aperture to display a particular number of sections, wherein an elongated column is moved in or out through its aperture in order to simulate the increasing or decreasing number of chips in a stack.

2. The gaming table as claimed in claim 1 in which said elongated columns are electrically controlled to display any number of sections, from zero to forty, for instance.

3. The gaming table as claimed in claim 2 in which said adjustable elongated columns are located in a designated chip-own area associated with each player to represent chips belonging to each said player.

4. The gaming table as claimed in claim 3 in which said adjustable elongated columns are located in a designated chip-bet area associated with each player to represent chips wagered by each said player and/or in a designated chip-bet area associated with all players to represent chips wagered by all players.

5. The gaming table as claimed in claim 4 in which manually operated switch means associated with each player allow each said player to select one of the conventional gaming options of the game being played, such as bet, call, raise or pass, for instance.

6. The gaming table as claimed in claim 5 in which the selection or repeated selection of a betting option by a player results in the wagering by said player or one or more chips, or of a number of chips established as the minimum or nominal betting amount for the game, a multiple of that number, or any portion of such that said player possesses.

7. The gaming table as claimed in claim 6 in which the elongated columns in said chip-own area associated with a player making a wager are reduced by a number of sections corresponding to the number of chips wagered by said player, upon the selection of a betting option by said player.

8. The gaming table as claimed in claim 7 in which the elongated columns in said chip-bet area associated with a player making a wager or the elongated columns in said chip-bet area associated with all players are increased by a number of sections corresponding to the number of chips wagered by said player.

9. The gaming table as claimed in claim 8 in which the elongated columns in said chip-own area associated with a player selected as winner are increased by a number of sections corresponding to the number of chips won by said player.

10. The gaming guide as claimed in claim 9 in which the elongated columns in said chip-bet area associated with a player selected as winner, the elongated columns in said chip-bet area associated with each player, or the elongated columns in said chip-bet area associated with all players are reduced by a number of sections, upon the readjustment of the elongated columns in said chip-own area associated with the player selected as winner.

11. The gaming guide as claimed in claim 10 in which winners are selected automatically when certain conditions of the game are met, or manually by operation of control switch means.

12. The gaming guide as claimed in claim 11 in which manually operated switch means allow the selling or purchasing of chips to and from a player, resulting in the elongated columns in said chip-own area associated with said player to be increased or decreased by a number of sections corresponding to the number of chips being sold or bought.

13. The gaming guide as claimed in claim 12 in which visual indicator means indicate when players are allowed, entitled or compelled to exercise a gaming option, and/or the player designated to select a gaming option, according to some established play selection pattern.

14. The gaming guide as claimed in claim 13 in which on-off switch means located in an area associated with each player and/or switch means associated with a designated dealer allow the disabling of the gaming selection switch means associated with each said player or the disabling of the electronic circuitry controlling the elongated columns located in said chip-own area associated with each said player.

15. The gaming guide as claimed in claim 14 in which said elongated columns may contain sections representing chips of different denomination that are distinguished by differences in size, color or design.

16. The gaming guide as claimed in claim 15 in which elongated columns representing chips of higher denomination such as five, for instance, are raised or lowered by one section for every five sections that the elongated columns representing chips of lower denomination such as one, for instance, would have been displaced.

17. The gaming guide as claimed in claim 16 in which an electro-mechanical device incorporated into a gaming table comprising an electro-mechanical or electric motor means, a manually operated switch means controlling the operation of said electro-mechanical or electric motor means, and a electronic control means that control and monitor the operation of each said component and the overall operation of the system.

18. The gaming guide as claimed in claim 17 in which sensor means and/or electronic control means detect the sectional displacement of said elongated columns and/or the position of said elongated columns within the table or in reference to the tabletop.

19. The gaming guide as claimed in claim 18 in which said manually operated switch means, said electro-mechanical or electric motor means, said sensor means, said indicator means and other means are connected to and controlled by a general purpose computer via a PC-based data acquisition/control system I/O interface board or a dedicated microprocessor-controlled board.

20. The gaming guide as claimed in claim 19 in which data pertaining to the conditions of the game such as the nominal betting amount, the maximum number of betting cycles and the like can be routinely modified.

21. The gaming guide as claimed in claim 20 which is easily adaptable to conventional table type games and which does not alter the traditional rules of said games.

22. The gaming guide as claimed in claim 21 which contains provisions for the electronic transfer of data to and from a host computer.

23. The gaming guide as claimed in claim 22 in which; the electro-mechanical or electric motor means controlling the displacement of the elongated columns located in said chip-own and chip-bet areas associated with a player making a wager are activated to respectively raise and lower said elongated columns by a number of sections corresponding to the number of chips wagered by said player, upon selection of a betting option by said player; the electro-mechanical or electric motor means controlling the displacement of the elongated columns located in said chip-bet area associated with all players are activated to raise said elongated columns by a number of sections corresponding to the number of chips wagered by all players, while the electro-mechanical or electric motor means controlling the displacement of the elongated columns located in said chip-bet areas associated with all players are activated to lower said elongated columns, upon completion of a betting selection cycle by all players; the electro-mechanical or electric motor means controlling the displacement of the elongated columns located in said chip-own area associated with a player selected as winner are activated to raise said elongated columns by a number of sections corresponding to the number of chips won by said player, while the electro-mechanical or electric motor means controlling the displacement of the elongated columns located in said chip-bet area associated with all players are activated to lower said elongated columns by a corresponding number of sections, upon selection of winners at the end of a game.

* * * * *